US008151486B2

(12) United States Patent
Dua

(10) Patent No.: US 8,151,486 B2
(45) Date of Patent: Apr. 10, 2012

(54) FLUID-FILLED CHAMBER WITH A TEXTILE TENSILE MEMBER

(75) Inventor: Bhupesh Dua, Portland, OR (US)

(73) Assignee: Nike, Inc., Beaverton, OR (US)

( * ) Notice: Subject to any disclaimer, the term of this patent is extended or adjusted under 35 U.S.C. 154(b) by 995 days.

(21) Appl. No.: 12/123,612

(22) Filed: May 20, 2008

(65) Prior Publication Data

US 2009/0288312 A1 Nov. 26, 2009

(51) Int. Cl.
*A43B 13/20* (2006.01)

(52) U.S. Cl. ..... 36/29; 36/35 R; 36/30 R; 36/93; 36/102; 36/405

(58) Field of Classification Search ..... 36/35 R, 36/30 R, 93, 29, 102, 405
See application file for complete search history.

(56) References Cited

U.S. PATENT DOCUMENTS

| | | | | |
|---|---|---|---|---|
| 3,253,355 | A | | 5/1966 | Menken |
| 3,984,926 | A | | 10/1976 | Calderon |
| 4,025,974 | A | | 5/1977 | Lea et al. |
| 4,219,945 | A | | 9/1980 | Rudy |
| 4,287,250 | A | | 9/1981 | Rudy |
| 4,513,449 | A | | 4/1985 | Donzis |
| 4,619,055 | A | | 10/1986 | Davidson |
| 4,785,558 | A | | 11/1988 | Shiomura |
| 4,874,640 | A | | 10/1989 | Donzis |
| 4,906,502 | A | | 3/1990 | Rudy |
| 5,083,361 | A | | 1/1992 | Rudy |
| 5,134,790 | A | | 8/1992 | Woitschaetzke et al. |
| 5,369,896 | A | | 12/1994 | Frachey et al. |
| 5,543,194 | A | | 8/1996 | Rudy |
| 5,572,804 | A | | 11/1996 | Skaja et al. |
| 5,630,237 | A | | 5/1997 | Ku |
| 5,741,568 | A | | 4/1998 | Rudy |
| 5,802,739 | A | | 9/1998 | Potter et al. |
| 5,918,383 | A | | 7/1999 | Chee |
| 5,987,781 | A | * | 11/1999 | Pavesi et al. ..... 36/29 |
| 5,993,585 | A | * | 11/1999 | Goodwin et al. ..... 156/145 |
| 6,029,962 | A | | 2/2000 | Shorten et al. |
| 6,041,521 | A | | 3/2000 | Wong |

(Continued)

FOREIGN PATENT DOCUMENTS

DE 196 16 004 10/1997

OTHER PUBLICATIONS

International Search Report and Written Opinion for PCT/US2009/044081, mailed Sep. 16, 2009.

*Primary Examiner* — Laurie Cranmer
(74) *Attorney, Agent, or Firm* — Plumsea Law Group, LLC.

(57) ABSTRACT

A fluid-filled may include including an outer barrier, a tensile member, and a fluid. The tensile member may be located within barrier and formed from a textile element that includes a pair of spaced layers joined by a plurality of connecting members. In some configurations, an edge of the tensile member may have a finished configuration or the tensile member may be contoured. The fluid is also located within the barrier and pressurized to place an outward force upon the barrier. In manufacturing a fluid-filled chamber, a textile tensile member may be formed with at least one contoured surface or a finished edge. The tensile member is then located within a polymer barrier and bonded to opposite sides of the barrier.

23 Claims, 20 Drawing Sheets

U.S. PATENT DOCUMENTS

| | | | | |
|---|---|---|---|---|
| 6,098,313 | A | 8/2000 | Skaja | |
| 6,119,371 | A * | 9/2000 | Goodwin et al. | 36/29 |
| 6,127,010 | A | 10/2000 | Rudy | |
| 6,385,864 | B1 | 5/2002 | Sell, Jr. et al. | |
| 6,837,951 | B2 | 1/2005 | Rapaport | |
| 6,944,973 | B2 * | 9/2005 | Goodwin | 36/29 |
| 7,070,845 | B2 * | 7/2006 | Thomas et al. | 428/69 |
| 7,076,891 | B2 * | 7/2006 | Goodwin | 36/29 |
| 7,131,218 | B2 | 11/2006 | Schindler | |
| 7,386,946 | B2 * | 6/2008 | Goodwin | 36/29 |
| 7,752,772 | B2 * | 7/2010 | Hatfield et al. | 36/29 |
| 2002/0121031 | A1 | 9/2002 | Smith et al. | |
| 2003/0097767 | A1 | 5/2003 | Perkinson | |
| 2005/0039346 | A1 | 2/2005 | Thomas et al. | |
| 2005/0097777 | A1 | 5/2005 | Goodwin | |
| 2006/0230636 | A1 | 10/2006 | Kokstis et al. | |
| 2007/0169379 | A1 | 7/2007 | Hazenberg et al. | |

* cited by examiner

FLUID-FILLED CHAMBER WITH A TEXTILE TENSILE MEMBER

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace is utilized to modify the dimensions of the void and secure the foot within the void.

The sole structure is located adjacent to a lower portion of the upper and is generally positioned between the foot and the ground. In many articles of footwear, including athletic footwear, the sole structure conventionally incorporates an insole, a midsole, and an outsole. The insole is a thin compressible member located within the void and adjacent to a lower surface of the void to enhance footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

The conventional midsole is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many conventional midsoles are primarily formed from a foamed polymer material, fluid-filled chambers or other non-foam structures may form a majority of some midsole configurations.

SUMMARY

A fluid-filled chamber is disclosed as including an outer barrier, a tensile member, and a fluid. The barrier is formed of a polymer material that defines an interior void. The tensile member is located within the interior void and bonded to opposite sides of the interior void. The tensile member is formed from a textile element that includes a pair of spaced layers joined by a plurality of connecting members. In some configurations, an edge of the tensile member may have a finished configuration or the tensile member may be contoured. The fluid is located within the interior void and is pressurized to place an outward force upon the barrier and induce tension in at least a portion of the tensile member.

A method of manufacturing a fluid-filled chamber is also disclosed. The method includes forming a textile tensile member with at least one contoured surface or a finished edge. The tensile member is located within a polymer barrier and bonded to opposite sides of the barrier.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of fluid-filled chambers and methods for manufacturing the chambers. Although the chambers are disclosed with reference to footwear having a configuration that is suitable for running, concepts associated with the chambers may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the chambers may also be utilized with footwear styles that are generally considered to be non-athletic, including dress shoes, loafers, and sandals. In addition to footwear, the chambers may be incorporated into other types of apparel and athletic equipment, including helmets, gloves, and protective padding for sports such as football and hockey. Similar chambers may also be incorporated into cushions and other compressible structures utilized in household goods and industrial products. Accordingly, chambers incorporating the concepts disclosed herein may be utilized with a variety of products.

General Footwear Structure

Figure 1:
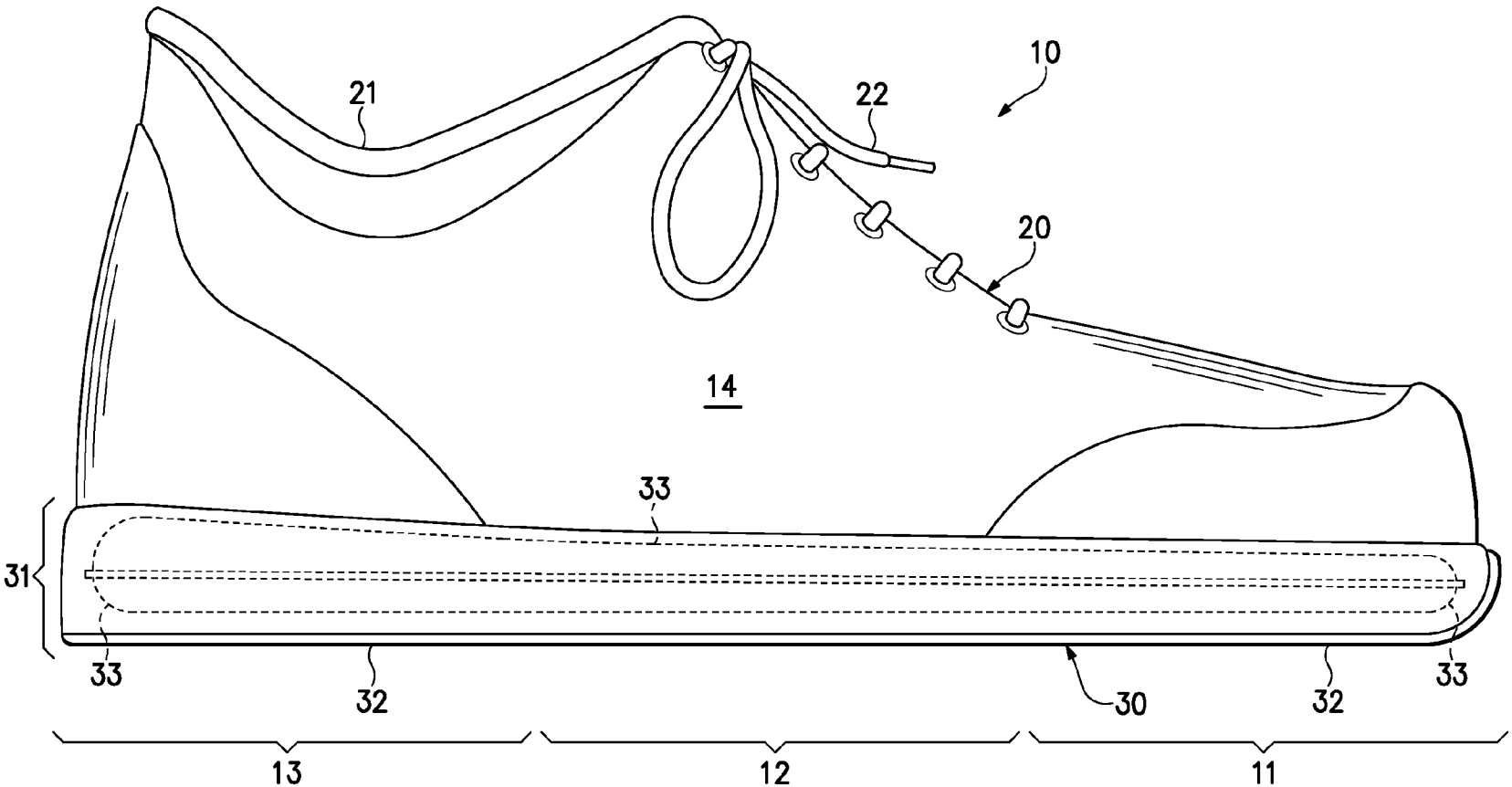
FIG. 1 is a lateral side elevational view of an article of footwear incorporating a fluid-filled chamber.
Figure 2:
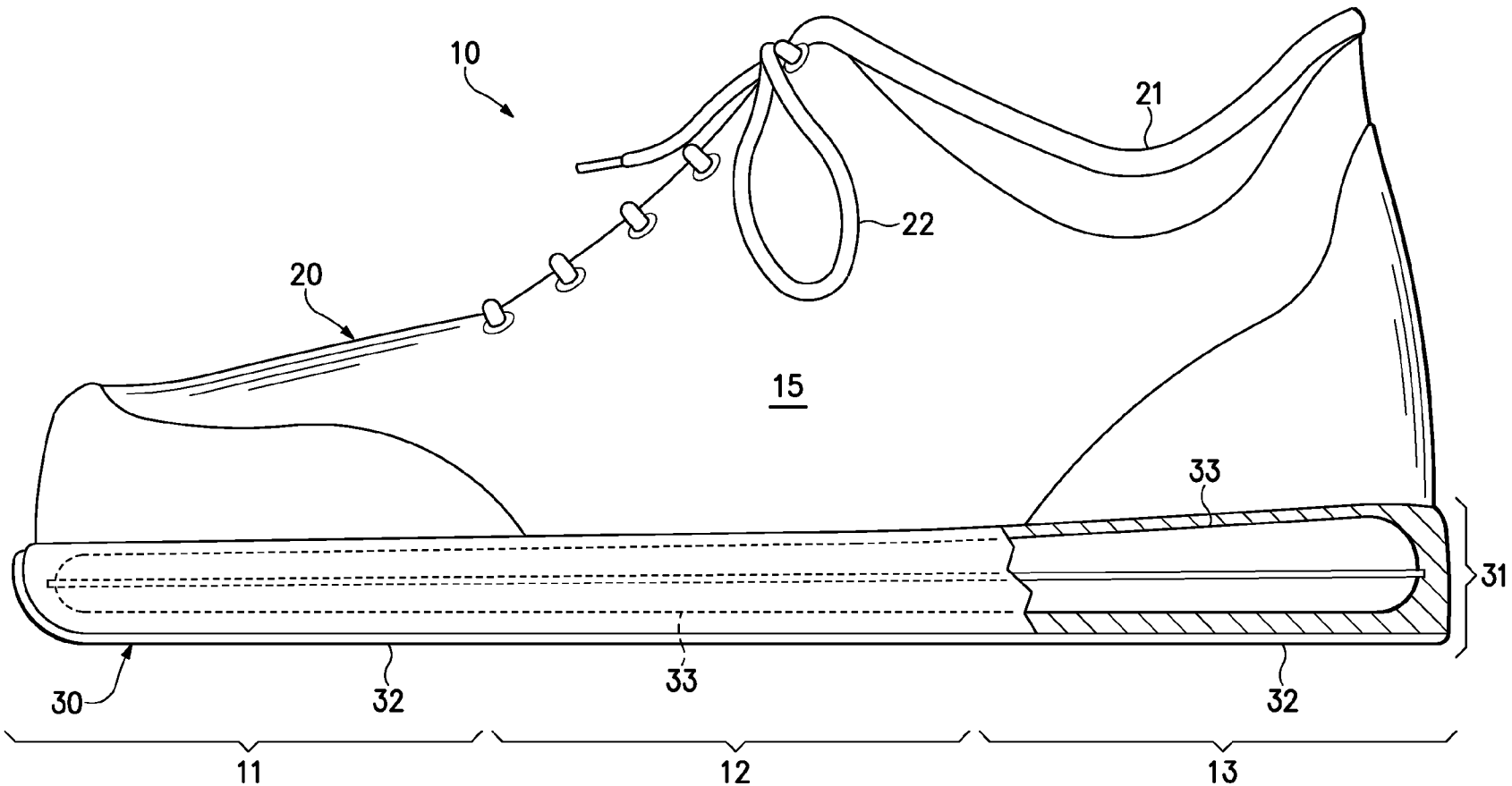
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textile, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or non-conventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation. The primary elements of sole structure 30 are a midsole 31 and an outsole 32. Midsole 31 may be formed from a polymer foam material, such as polyurethane or ethylvinylacetate, that encapsulates a fluid-filled chamber 33. In addition to the polymer foam material and chamber 33, midsole 31 may incorporate one or more additional footwear elements that enhance the comfort, performance, or ground reaction force attenuation properties of footwear 10, including plates, moderators, lasting elements, or motion control members. Outsole 32, which may be absent in some configurations of footwear 10, is secured to a lower surface of midsole 31 and may be formed from a rubber material that provides a durable and wear-resistant surface for engaging the ground. In addition, outsole 32 may also be textured to enhance the traction (i.e., friction) properties between footwear 10 and the ground. Sole structure 30 may also incorporate an insole or sockliner that is located with in the void in upper 20 and adjacent a plantar (i.e., lower) surface of the foot to enhance the comfort of footwear 10.

Chamber Configuration

Chamber 33 is depicted individually in FIGS. 3-9 as having a configuration that is suitable for footwear applications. When incorporated into footwear 10, chamber 33 has a shape that fits within a perimeter of midsole 31 and substantially extends from forefoot region 11 to heel region 13 and also from lateral side 14 to medial side 15, thereby corresponding with a general outline of the foot. Although the polymer foam material of midsole 31 is depicted as forming a sidewall of midsole 31, chamber 33 may form a portion of the sidewall in some configurations of footwear 10. When the foot is located within upper 20, chamber 33 extends under substantially all of the foot in order to attenuate ground reaction forces that are generated when sole structure 30 is compressed between the foot and the ground during various ambulatory activities, such as running and walking. In other configurations, chamber 33 may extend under only a portion of the foot.

The primary elements of chamber 33 are a barrier 40 and a tensile member 50. Barrier 40 forms an exterior of chamber 33 and (a) defines an interior void that receives both a pressurized fluid and tensile member 50 and (b) provides a durable sealed barrier for retaining the pressurized fluid within chamber 33. The polymer material of barrier 40 includes an upper barrier portion 41, an opposite lower barrier portion 42, and a sidewall barrier portion 43 that extends around a periphery of chamber 33 and between barrier portions 41 and 42. Tensile member 50 is located within the interior void and has a configuration of a spacer-knit textile that includes an upper tensile layer 51, an opposite lower tensile layer 52, and a plurality of connecting members 53 that extend between tensile layers 51 and 52. Whereas upper tensile layer 51 is secured to an inner surface of upper barrier portion 41, lower tensile layer 52 is secured to an inner surface of lower barrier portion 42. Either adhesive bonding or thermobonding, for example, may be utilized to secure tensile member 50 to barrier 40.

In manufacturing chamber 33, a pair of polymer sheets may be molded and bonded during a thermoforming process to define barrier portions 41-43. More particularly, the thermoforming process (a) imparts shape to one of the polymer sheets in order to form upper barrier portion 41 and an upper area of sidewall portion 43 (b) imparts shape to the other of the polymer sheets in order to form lower barrier portion 42 and a lower area of sidewall barrier portion 43, and (c) forms a peripheral bond 44 that joins a periphery of the polymer sheets and extends around sidewall barrier portion 43. The thermoforming process may also locate tensile member 50 within chamber 33 and bond tensile member 50 to each of barrier portions 41 and 42. Although substantially all of the thermoforming process may be performed with a mold, as described in greater detail below, each of the various parts of the process may be performed separately in forming chamber 33.

Following the thermoforming process, a fluid may be injected into the interior void and pressurized. The pressurized fluid exerts an outward force upon chamber 33, which tends to separate barrier portions 41 and 42. Tensile member 50, however, is secured to each of barrier portions 41 and 42 in order to retain the intended shape of chamber 33 when pressurized. More particularly, connecting members 53 extend across the interior void and are placed in tension by the outward force of the pressurized fluid upon barrier 40, thereby preventing barrier 40 from expanding outward and retaining the intended shape of chamber 33. Whereas peripheral bond 44 joins the polymer sheets to form a seal that prevents the fluid from escaping, tensile member 50 prevents chamber 33 from expanding outward or otherwise distending due to the pressure of the fluid. That is, tensile member 50 effectively limits the expansion of chamber 33 to retain an intended shape of surfaces of barrier portions 41 and 42.

Figure 3:
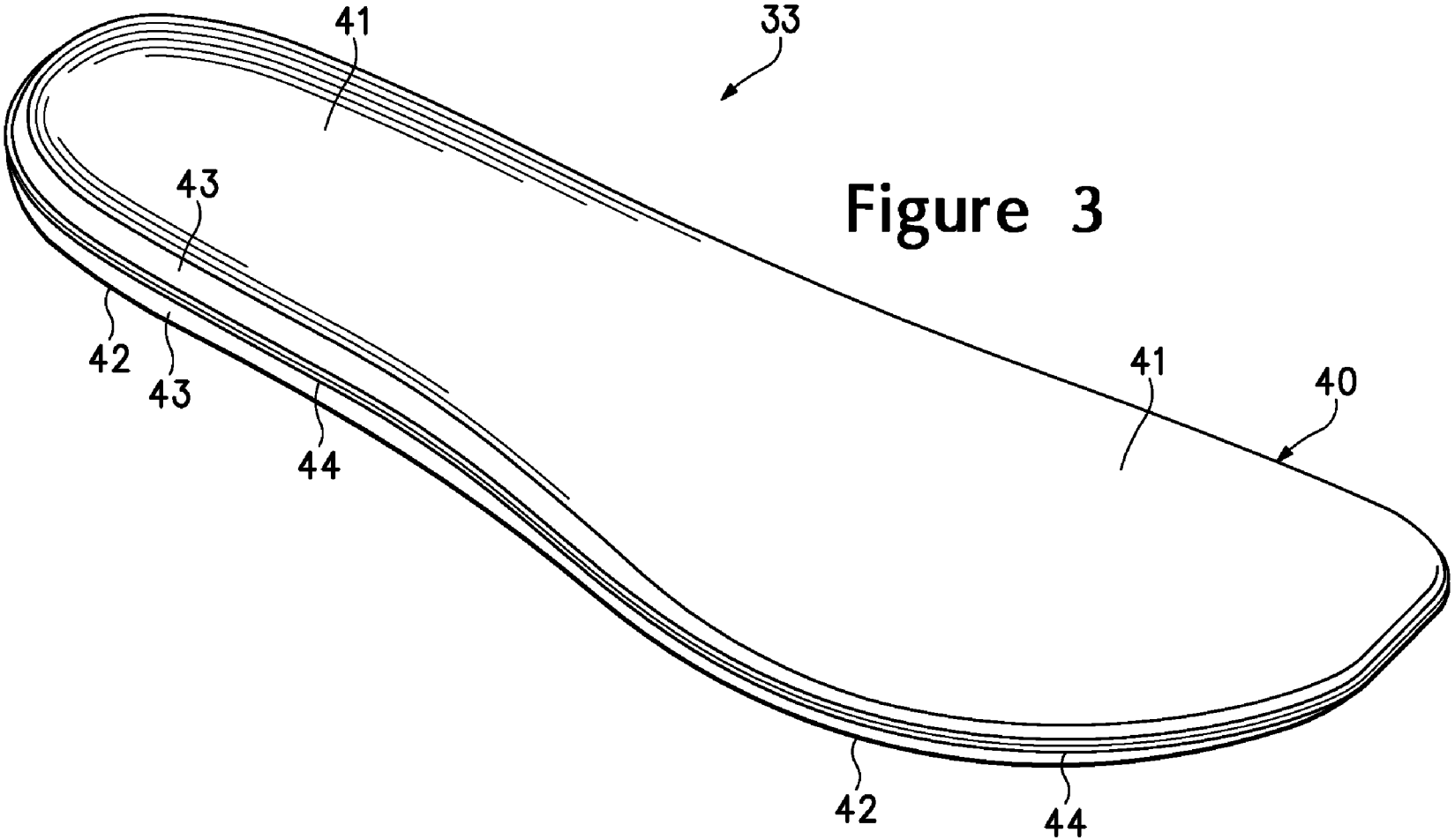
FIG. 3 is a perspective view of the chamber.
Figure 4:
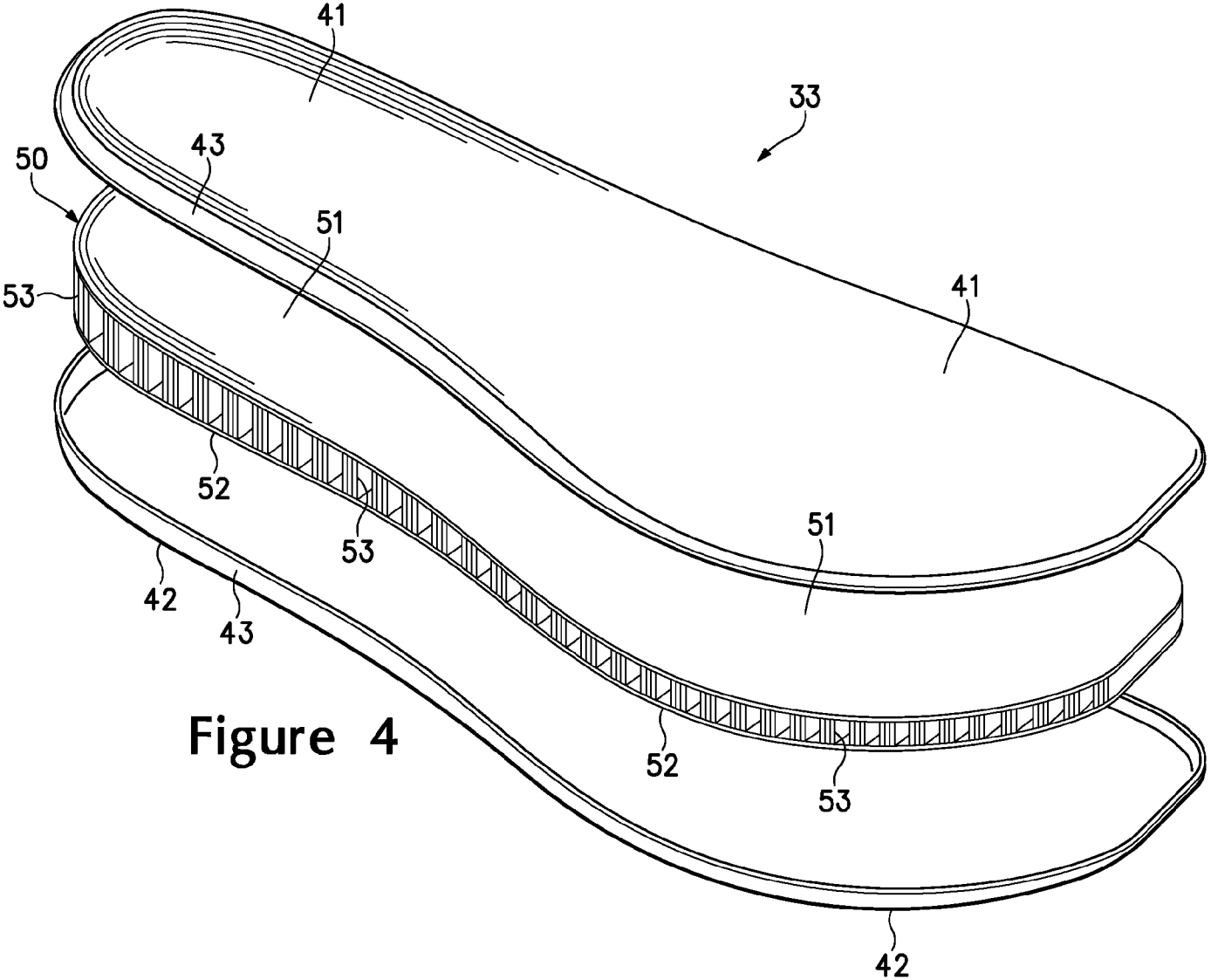
FIG. 4 is an exploded perspective view of the chamber.
Figure 5:
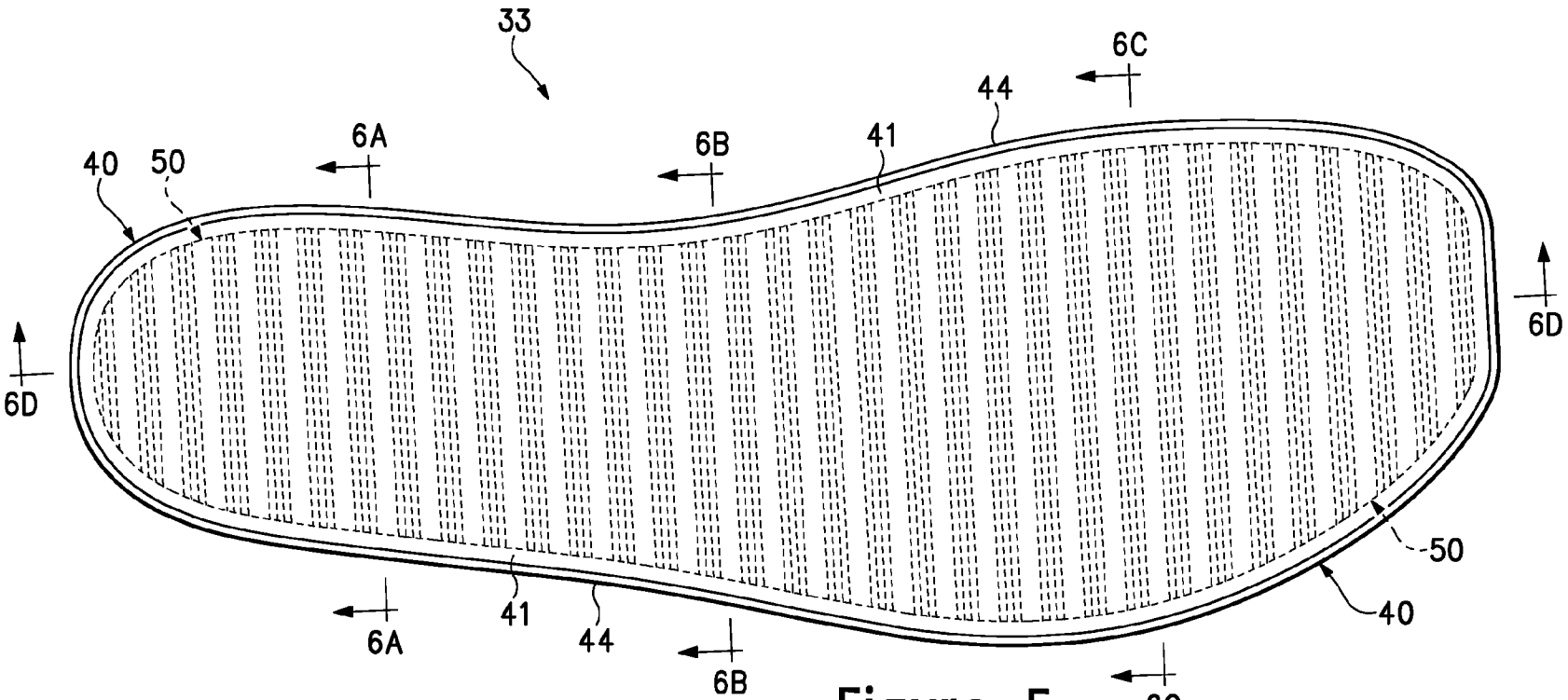
FIG. 5 is a top plan view of the chamber.
Figure 6A:
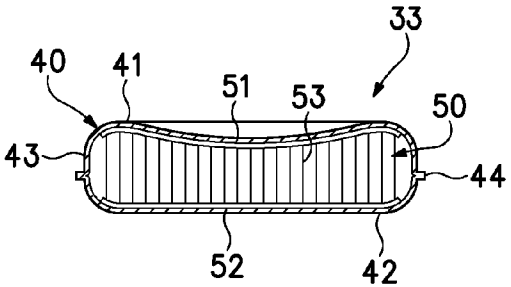
FIGS. 6A-6D are cross-sectional views of the chamber, as defined by section lines 6A-6D in FIG. 5.
Figure 6B:
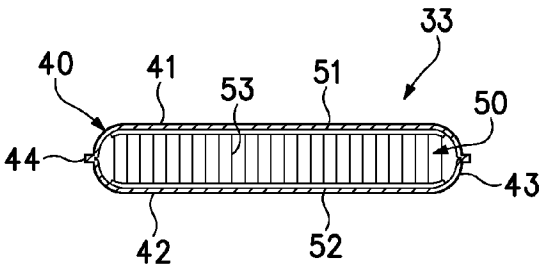
Figure 6C:
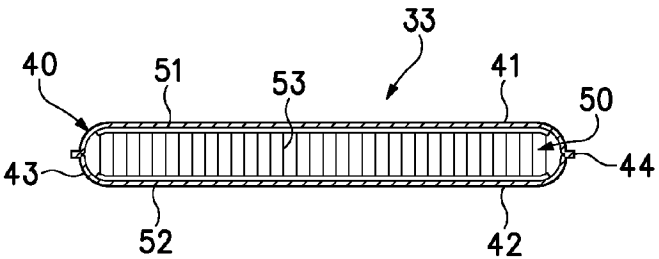
Figure 6D:
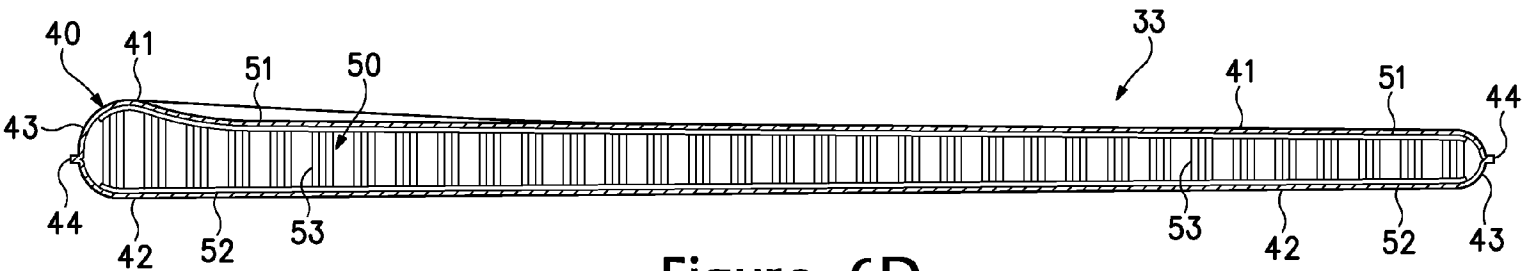
Figure 7:
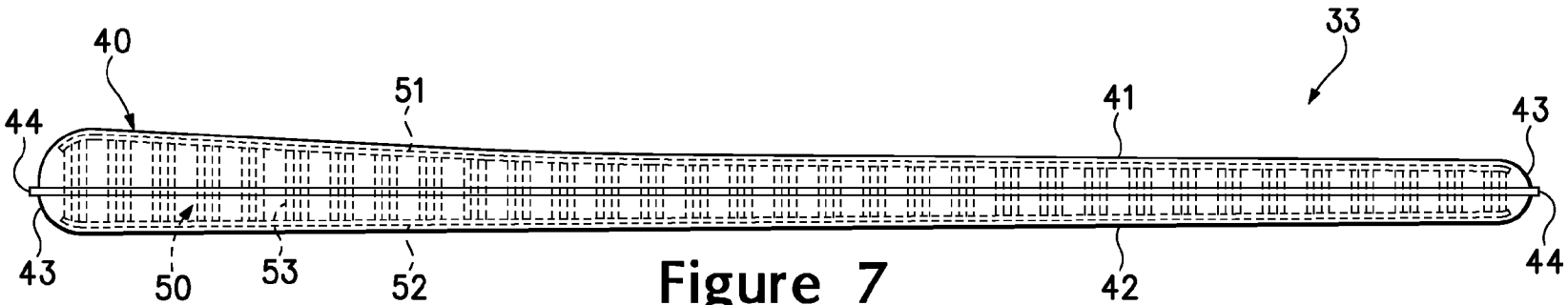
FIG. 7 is a lateral side elevational view of the chamber.
Figure 8:
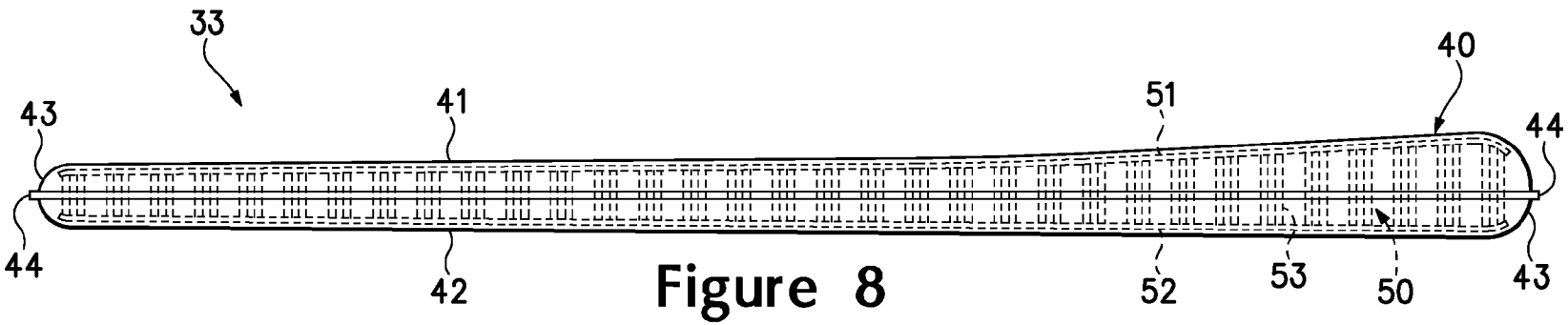
FIG. 8 is a medial side elevational view of the chamber.
Figure 9:
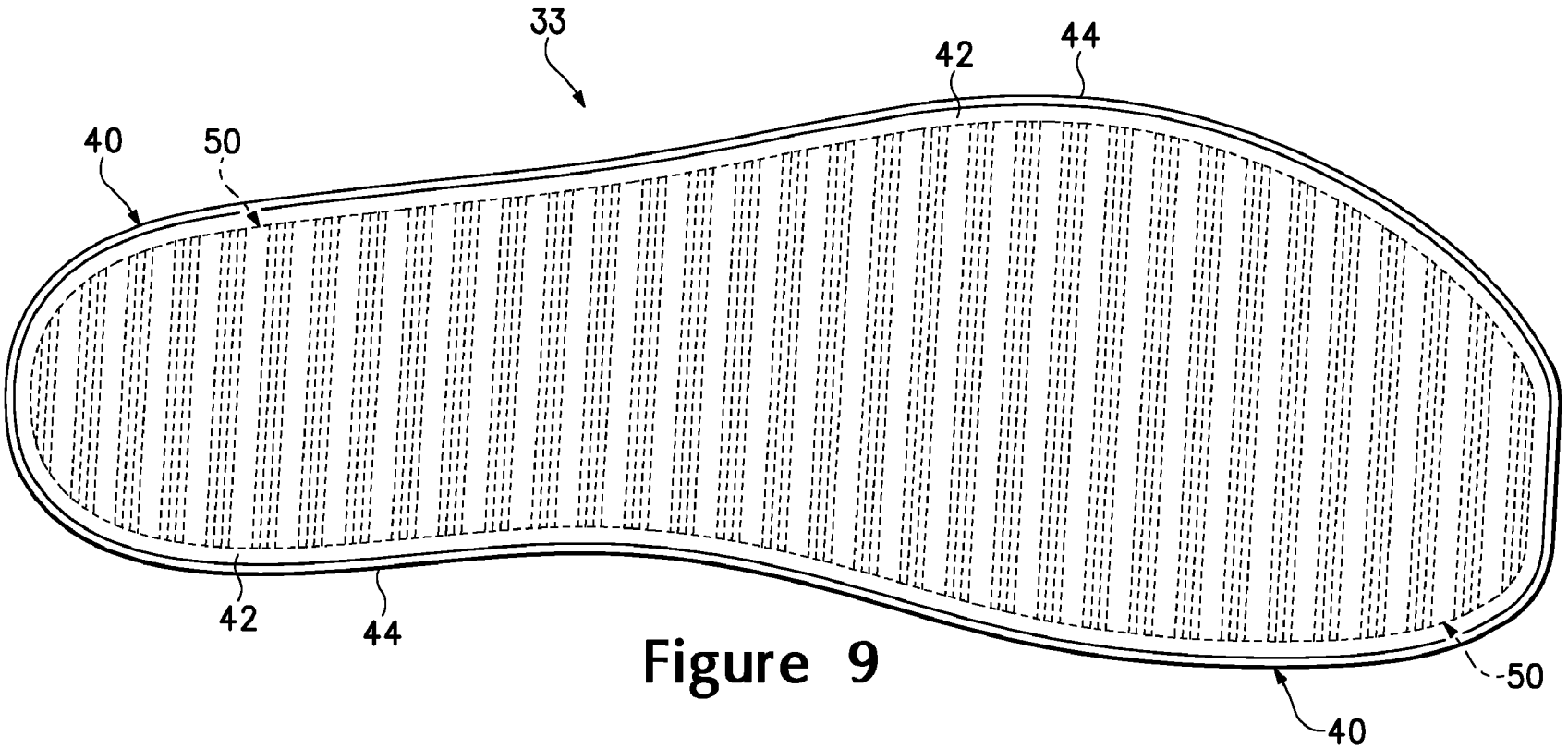
FIG. 9 is a bottom plan view of the chamber.
Figure 10:
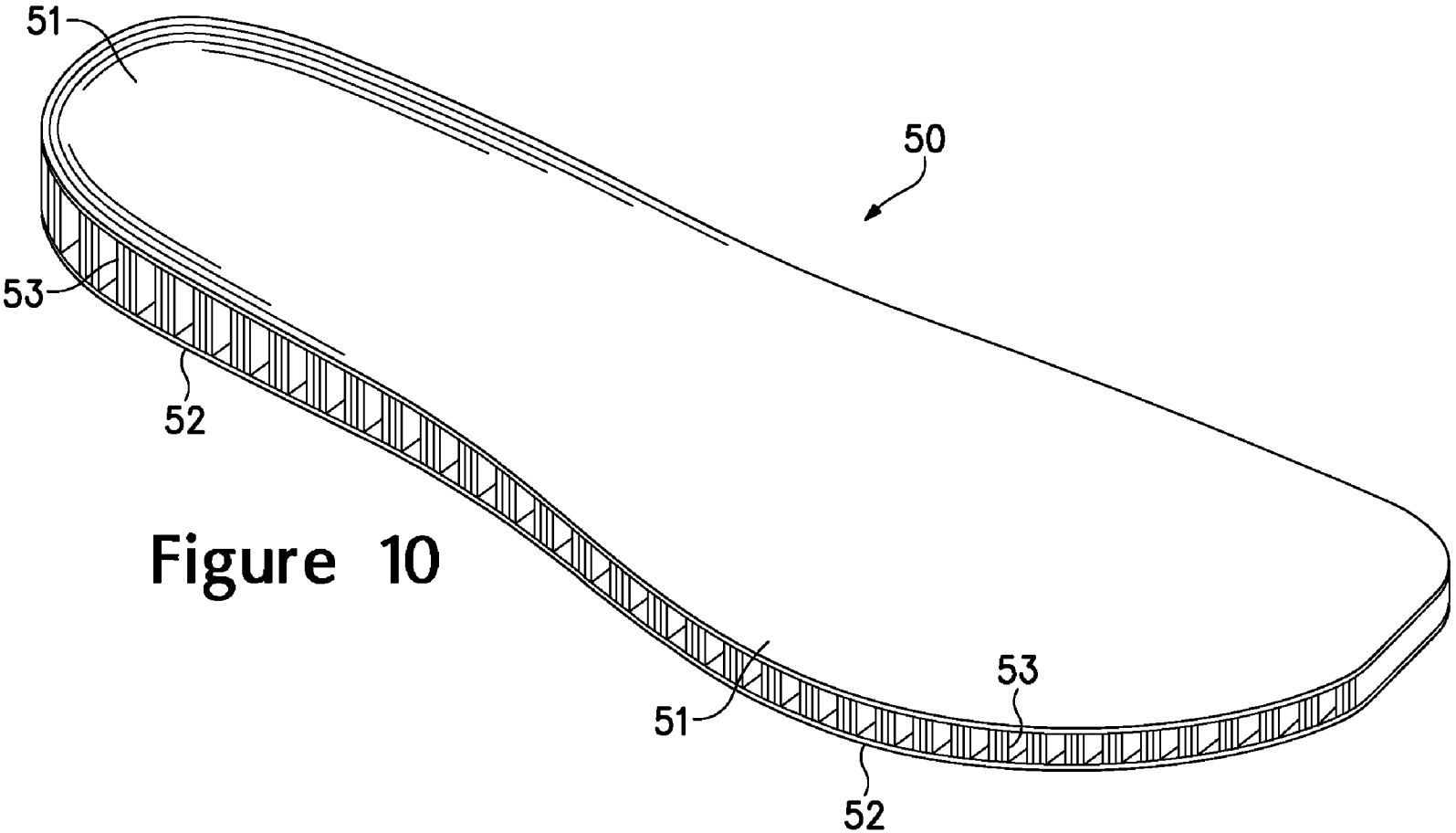
FIG. 10 is a perspective view of a tensile member of the chamber.
Figure 11:
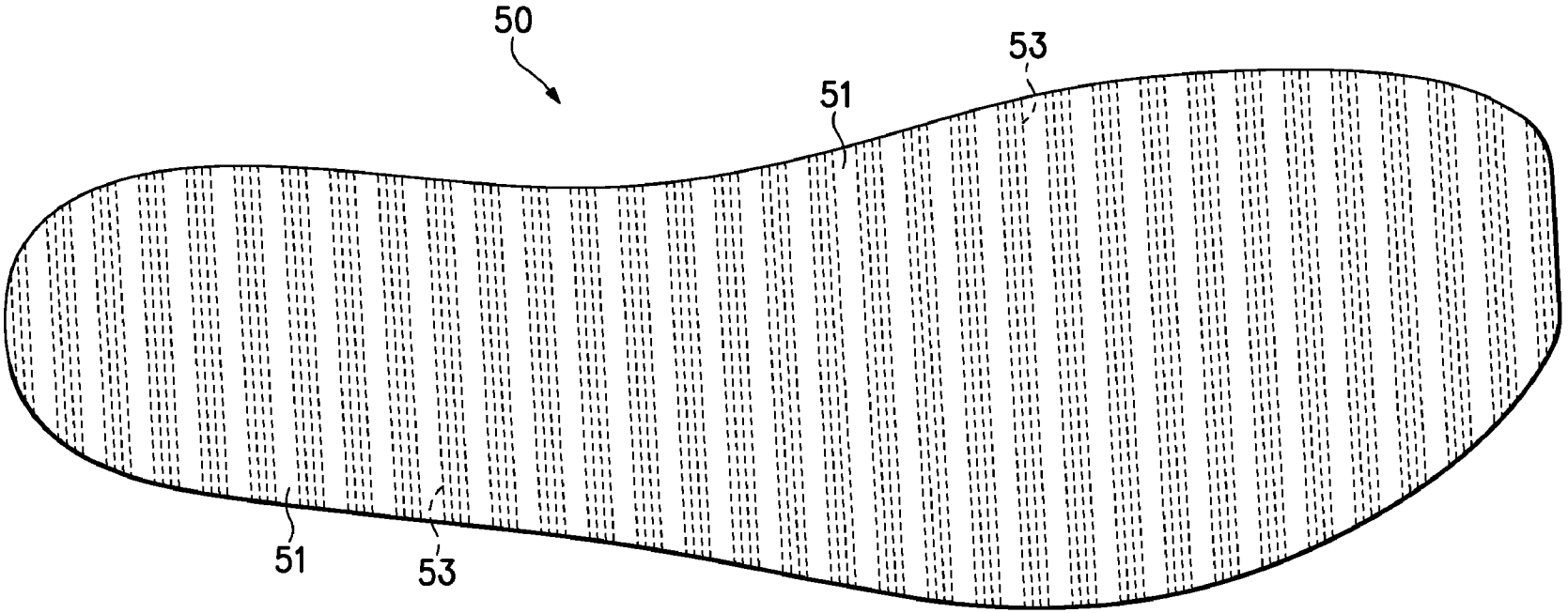
FIG. 11 is a top plan view of the tensile member.
Figure 12:
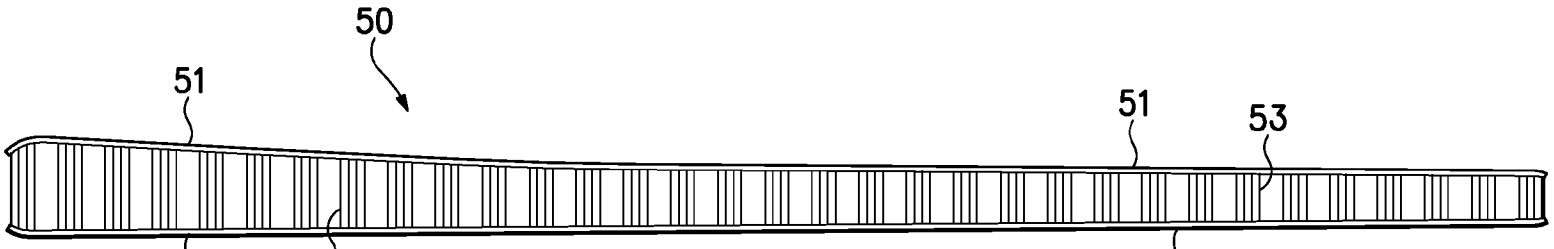
FIG. 12 is a lateral side elevational view of the tensile member.
Figure 13:
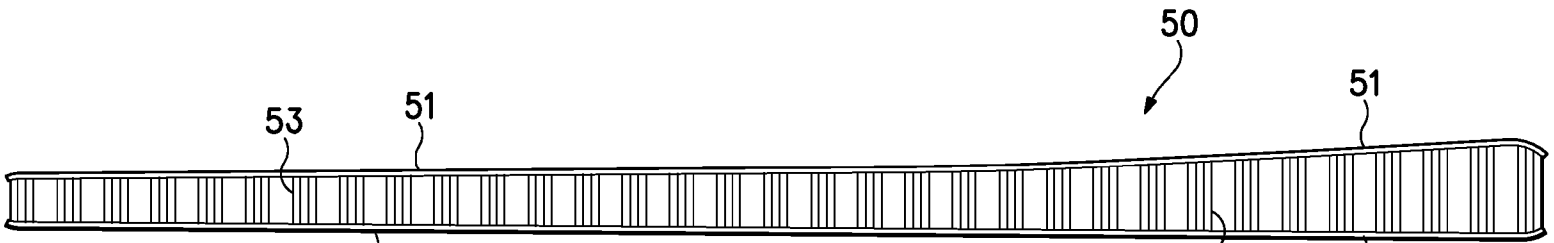
FIG. 13 is a medial side elevational view of the tensile member.
Figure 14:
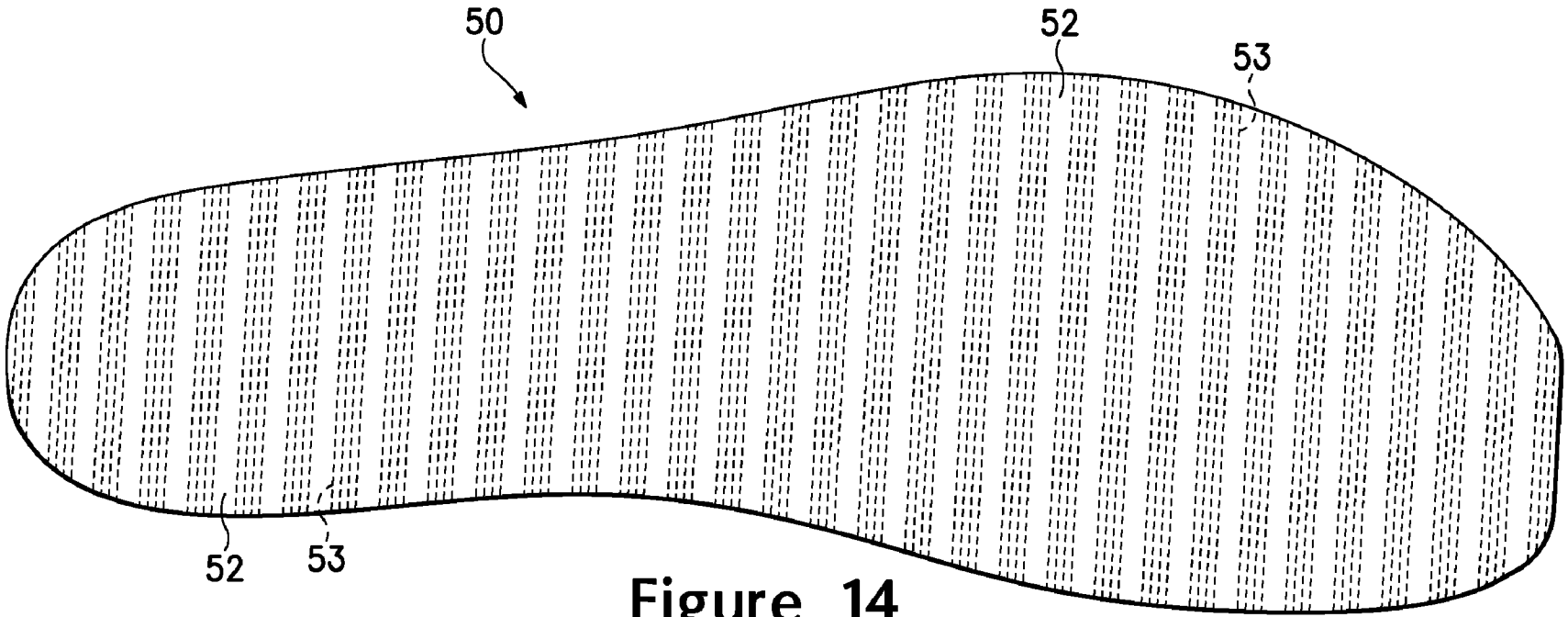
FIG. 14 is a bottom plan view of the tensile member.

Chamber 33 is shaped and contoured to provide a structure that is suitable for footwear applications. As noted above, chamber 33 has a shape that fits within a perimeter of midsole 31 and extends under substantially all of the foot, thereby corresponding with a general outline of the foot. In addition, surfaces corresponding with barrier portions 41 and 42 are contoured in a manner that is suitable for footwear applications. With reference to FIGS. 7 and 8, chamber 33 exhibits a tapered configuration between heel region 13 and forefoot region 11. That is, the portion of chamber 33 in heel region 13 exhibits a greater overall thickness than the portion of chamber 33 in forefoot region 11. When incorporated into footwear 10, the tapering of chamber 33 ensures that the heel of the foot is slightly raised in relation to the forefoot. In addition to tapering, upper barrier portion 41 is contoured to provide support for the foot. Whereas lower barrier portion 42 has a generally planar configuration between sides 14 and 15, upper barrier portion 41 forms a depression in heel region 13 for receiving the heel of the foot, as depicted in FIGS. 3, 6A, and 6B. That is, the heel of the foot may rest within the depression to assist with securing the position of the foot relative to chamber 33. In addition, upper barrier portion 41 has a generally planar configuration in forefoot region 11 for supporting forward portions of the foot, as depicted in FIGS. 3, 6A, and 6D. Accordingly, upper barrier portion 41 defines various contours to complement the general anatomical structure of the foot.

The fluid within chamber 33 may be pressurized between zero and three-hundred-fifty kilopascals (i.e., approximately fifty-one pounds per square inch) or more. In addition to air and nitrogen, the fluid may include octafluorapropane or be any of the gasses disclosed in U.S. Pat. No. 4,340,626 to Rudy, such as hexafluoroethane and sulfur hexafluoride. In some configurations, chamber 33 may incorporate a valve or other structure that permits the individual to adjust the pressure of the fluid.

A wide range of polymer materials may be utilized for chamber 33. In selecting materials for barrier 40, engineering properties of the material (e.g., tensile strength, stretch properties, fatigue characteristics, dynamic modulus, and loss tangent) as well as the ability of the material to prevent the diffusion of the fluid contained by barrier 40 may be considered. When formed of thermoplastic urethane, for example, barrier 40 may have a thickness of approximately 1.0 millimeter, but the thickness may range from 0.25 to 2.0 millimeters or more, for example. In addition to thermoplastic urethane, examples of polymer materials that may be suitable for chamber 33 include polyurethane, polyester, polyester polyurethane, and polyether polyurethane. Barrier 40 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for barrier 40 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

In order to facilitate bonding between tensile member 50 and barrier 40, polymer supplemental layers may be applied to each of tensile layers 51 and 52. When heated, the supplemental layers soften, melt, or otherwise begin to change state so that contact with barrier portions 41 and 42 induces material from each of barrier 40 and the supplemental layers to intermingle or otherwise join with each other. Upon cooling, therefore, the supplemental layer is permanently joined with barrier 40, thereby joining tensile member 50 with barrier 40. In some configurations, thermoplastic threads or strips may be present within tensile layers 51 and 52 to facilitate bonding with barrier 40, as disclosed in U.S. Pat. No. 7,070,845 to Thomas, et al., or an adhesive may be utilized to secure barrier 40 and tensile member 50.

Tensile Member Configuration

Tensile member 50, which is depicted individually in FIGS. 10-14, includes upper tensile layer 51, the opposite lower tensile layer 52, and the plurality of connecting members 53 that extend between tensile layers 51 and 52. Each of tensile layers 51 and 52 have a generally continuous and planar configuration, although upper tensile layer 51 is somewhat contoured to impart the tapered configuration and to form a depression in heel region 13. That is, the configuration of tensile member 50 corresponds with the overall configuration discussed above for chamber 33. Connecting members 53 are secured to each of tensile layers 51 and 52 and space tensile layers 51 and 52 apart from each other. More particularly, the outward force of the pressurized fluid places connecting members 53 in tension and restrains further outward movement of tensile layers 51 and 52 and barrier portions 41 and 42. Connecting members 53 are arranged in rows that are separated by gaps. The use of gaps provides tensile member 50 with increased compressibility in comparison to tensile members formed of double-walled fabrics that utilize continuous connecting members, although continuous connecting members 53 may be utilized in some configurations of chamber 33.

The lengths of connecting members 53 vary throughout tensile member 50. As with chamber 33, tensile member 50 has a tapered configuration between heel region 13 and forefoot region 11. In order to impart the tapered configuration, the lengths of connecting members 53 may decrease between heel region 13 and forefoot region 11. As with chamber 33, tensile member 50 also forms a depression in heel region 13. In order to provide the depression, connecting members 53 located adjacent to sides 14 and 15 may be longer than in a center of heel region 13. Accordingly, by varying the lengths of connecting members 53, contours may be imparted to tensile member 50.

Tensile member 50 is formed as a unitary (i.e., one-piece) textile element having the configuration of a spacer-knit textile. A variety of knitting techniques may be utilized to form tensile member 50 and impart a specific configuration (e.g., taper, contour, length, width, thickness) to tensile member 50. In general, knitting involves forming courses and wales of intermeshed loops of a yarn or multiple yarns. In production, knitting machines may be programmed to mechanically-manipulate yarns into the configuration of tensile member 50. That is, tensile member 50 may be formed by mechanically-manipulating yarns to form a one-piece textile element that has a particular configuration. The two major categories of knitting techniques are weft-knitting and warp-knitting. Whereas a weft-knit fabric utilizes a single yarn within each course, a warp-knit fabric utilizes a different yarn for every stitch in a course.

Although tensile member 50 may be formed through a variety of different knitting processes, an advantage of flat-knitting, which is a specific type of weft-knitting, is that generally three-dimensional structures may be produced. In contrast with the "flat" terminology in "flat-knitting", therefore, non-planar, curved, or otherwise generally three-dimensional structures may be produced through flat-knitting. As discussed above, tensile member 50 is a one-piece, spacer-knit textile element that includes upper tensile layer 51, lower tensile layer 52, and connecting members 53, which may be formed through flat-knitting. In general, flat-knitting is a method for producing a knitted fabric in which the fabric is turned periodically (i.e., the fabric is knitted from alternating sides). The two sides (otherwise referred to as faces) of the fabric are conventionally designated as the right side (i.e., the side that faces outwards, towards the viewer) and the wrong side (i.e., the side that faces inwards, away from the viewer). Although flat-knitting provides a suitable manner for forming restriction structure 30, other types of knitting may also be utilized, including wide tube circular knitting, narrow tube circular knit jacquard, single knit circular knit jacquard, double knit circular knit jacquard, warp knit jacquard, and double needle bar raschel knitting, for example. Accordingly, various weft-knitting and warp-knitting techniques may be utilized to manufacture tensile member 50.

Although one or more yarns may be mechanically-manipulated by an individual to form tensile member 50 (i.e., tensile member 50 may be formed by hand), flat-knitting machines may provide an efficient manner of forming relatively large numbers of tensile member 50. The flat-knitting machines may also be utilized to vary the dimensions of tensile member 50 to form tensile members 50 that are suitable for individuals with differently-sized feet. Additionally, the flat-knitting machines may be utilized to vary the configuration of tensile member 50 to form tensile members 50 that are suitable for both left and right feet. Accordingly, the use of mechanical flat-knitting machines may provide an efficient manner of forming multiple tensile members 50 having different sizes and configurations. Examples of flat-knitting machines that may be utilized to produce various sizes and configurations of tensile members 50 include.

Whereas edges of many textile materials are cut to expose ends of the yarns forming the textile materials, tensile member 50 may be formed to have a finished configuration. That is, flat-knitting or other knitting techniques may be utilized to form tensile member 50 such that ends of the yarns within tensile member 50 are substantially absent from the edges of tensile layers 51 and 52. An advantage of the finished configuration formed through flat-knitting is that the yarns forming the edges of tensile layers 51 and 52 are less likely to unravel, thereby degrading the structure of tensile member 50. In addition, loose yarns are also less likely to inhibit the aesthetic appearance of the interior of chamber 33 In other words, the finished configuration of tensile member 50 may enhance the durability and aesthetic qualities of chamber 33.

For purposes of the present discussion, the term "yarn" or variants thereof is intended to encompass a variety of generally one-dimensional materials (e.g., filaments, fibers, threads, strings, strands, and combinations thereof) that may be utilized to form a textile. The properties of tensile member 50 may relate to the specific materials that are utilized in the yarns. Examples of properties that may be relevant in selecting specific yarns for tensile member 50 include tensile strength, tensile modulus, density, flexibility, tenacity, resistance to abrasion, and resistance to degradation (e.g., from water, light, and chemicals). Examples of suitable materials for the yarns include rayon, nylon, polyester, polyacrylic, silk, cotton, carbon, glass, aramids (e.g., para-aramid fibers and meta-aramid fibers), ultra high molecular weight polyethylene, and liquid crystal polymer. Although each of these materials exhibit properties that are suitable for tensile member 50, each of these materials exhibit different combinations of material properties. Accordingly, the properties of yarns formed from each of these materials may be compared in selecting materials for the yarns within tensile member 50. Moreover, factors relating to the combination of yarns and the type of knit or type of textile may be considered in selecting a configuration for tensile member 50.

A further advantage of flat-knitting or other manufacturing techniques for tensile member 50 relates to the placement of yarns and course density. The type of yarn utilized in different areas of tensile member 50 may change to vary the properties of the different areas. For example, one area of tensile member 50 may stretch more than another area. Similarly, the type of yarn utilized on different sides of tensile member 50 may change to vary the properties of the different sides. Different properties may also be gained by changing the course density in different areas or on different sides of tensile member 50.

Based upon the above discussion, tensile member 50 incorporates various advantages, including contouring and the finished configuration. The contouring of tensile member 50 may be utilized to impart a variety of shapes to surfaces of chamber 33. As discussed above, chamber 33 is tapered between heel region 13 and forefoot region 11, and chamber 33 has a depression in heel region 13. These contours are imparted to chamber 33 by the configuration of tensile member 50. A variety of other contours (i.e., tapers, depressions, protrusions) may be imparted to chamber 33 by modifying the configuration of tensile member 50. In addition, the finished configuration of tensile member 50 may be utilized to enhance the durability and aesthetic qualities of chamber 33. Whereas the tensile members of some prior chambers were cut from a larger textile element, thereby exposing ends of the yarns, the knitting technique (e.g., with a flat-knitting machine) utilized to manufacture tensile member 50 may form tensile member 50 as an individual component with a finished configuration. In effect, tensile member 50 may be knitted with a flat-knitting machine to have the general shape of chamber 33. That is, tensile member 50 may be formed as depicted in FIGS. 10-14 without the need for additional cutting operations. Although flat-knitting may be utilized to form tensile member 50 to be contoured and have the finished configuration, other knitting techniques may also be utilized.

Manufacturing Process

Figure 15:
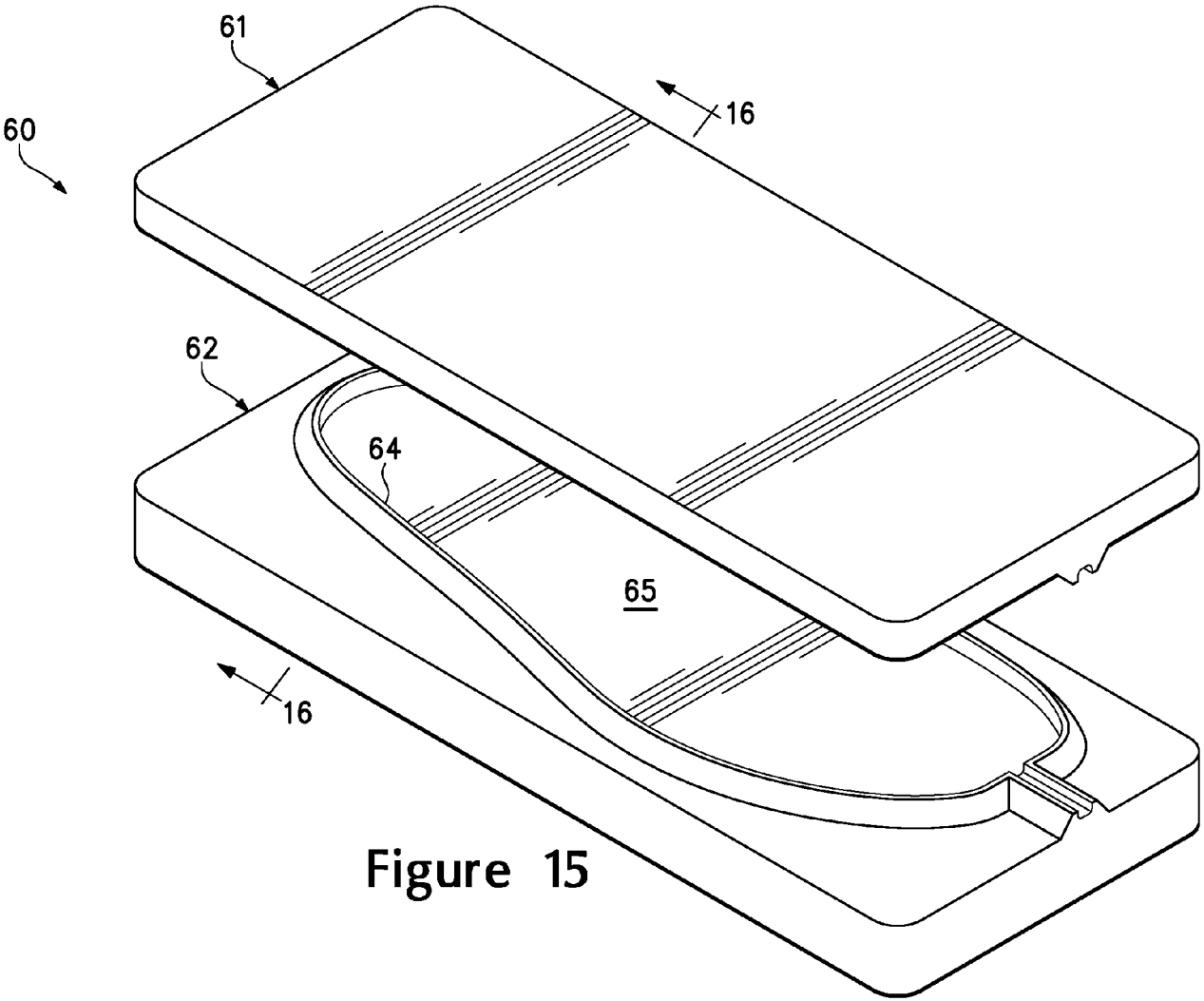
FIG. 15 is a perspective view of a mold for forming the chamber.

Although a variety of manufacturing processes may be utilized to form chamber 33, an example of a suitable thermoforming process will now be discussed. With reference to FIG. 15, a mold 60 that may be utilized in the thermoforming process is depicted as including an upper mold portion 61 and a lower mold portion 62. Mold 60 is utilized to form chamber 33 from a pair of polymer sheets that are molded and bonded to define surfaces 41-43, and the thermoforming process secures tensile member 50 within barrier 40. More particularly, mold 60 (a) imparts shape to one of the polymer sheets in order to form upper barrier portion 41 and an upper area of sidewall portion 43 (b) imparts shape to the other of the polymer sheets in order to form lower barrier portion 42 and a lower area of sidewall barrier portion 43, and (c) forms a peripheral bond 44 that joins a periphery of the polymer sheets and extends around sidewall barrier portion 43. Mold 60 also respectively bonds tensile layers 51 and 52 to barrier portions 41 and 42.

In manufacturing chamber 33, one or more of an upper polymer layer 71, a lower polymer layer 72, and tensile member 50 are heated to a temperature that facilitates bonding between the components. Depending upon the specific materials utilized for tensile member 50 and polymer layers 71 and 72, which form barrier 40, suitable temperatures may range from 120 to 200 degrees Celsius (248 to 392 degrees Fahrenheit) or more. As an example, a material having alternating layers of thermoplastic polyurethane and ethylene-vinyl alcohol copolymer may be heated to a temperature in a range of 149 to 188 degrees Celsius (300 and 370 degrees Fahrenheit) to facilitate bonding. Various radiant heaters or other devices may be utilized to heat the components of chamber 33. In some manufacturing processes, mold 60 may be heated such that contact between mold 60 and the components of chamber 33 raises the temperature of the components to a level that facilitates bonding.

Figure 16A:
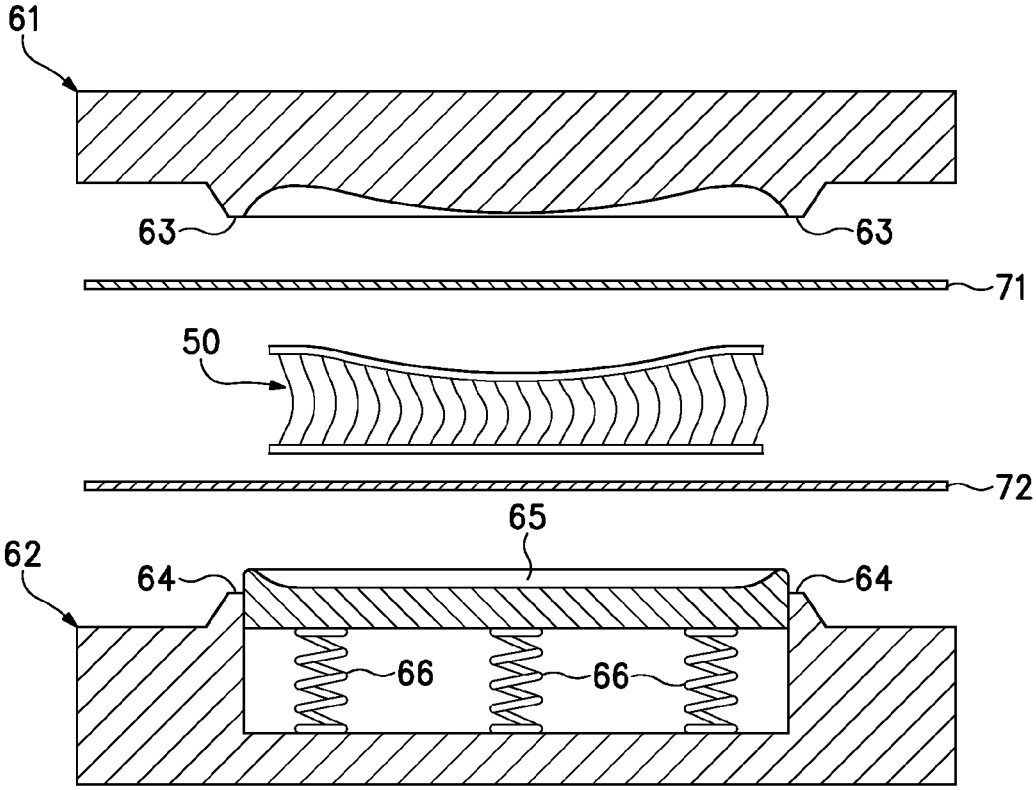
FIGS. 16A-16C are schematic cross-sectional views of the mold, as defined by section line 16 in FIG. 15, depicting steps in a manufacturing process for the chamber.
Figure 16B:
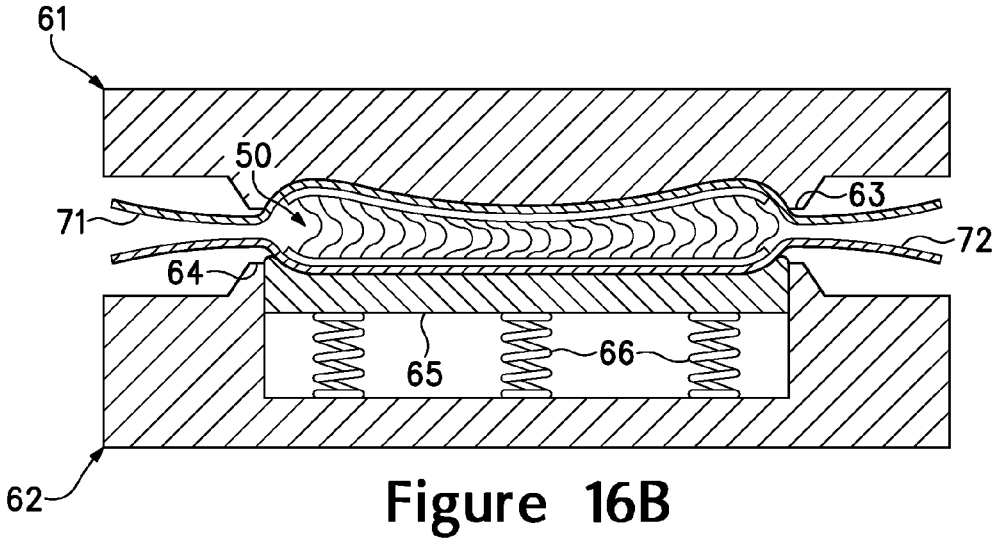

Following heating, the components of chamber 33 are located between mold portions 61 and 62, as depicted in FIG. 16A. In order to properly position the components, a shuttle frame or other device may be utilized. Once positioned, mold portions 61 and 62 translate toward each other and begin to close upon the components such that (a) a ridge 63 of upper mold portion 61 contacts upper polymer layer 71, (b) a ridge 64 of lower mold portion 62 contacts lower polymer layer 72, and (c) polymer layers 71 and 72 begin bending around tensile member 50 so as to extend into a cavity within mold 60, as depicted in FIG. 16B. Accordingly, the components are located relative to mold 60 and initial shaping and positioning has occurred.

At the stage depicted in FIG. 16B, air may be partially evacuated from the area around polymer layers 71 and 72 through various vacuum ports in mold portions 61 and 62. The purpose of evacuating the air is to draw polymer layers 71 and 72 into contact with the various contours of mold 60. This ensures that polymer layers 71 and 72 are properly shaped in accordance with the contours of mold 60. Note that polymer layers 71 and 72 may stretch in order to extend around tensile member 50 and into mold 60. In comparison with the thickness of barrier 40 in chamber 33, polymer layers 71 and 72 may exhibit greater thickness. This difference between the original thicknesses of polymer layers 71 and 72 and the resulting thickness of barrier 40 may occur as a result of the stretching that occurs during this stage of the thermoforming process.

In order to provide a second means for drawing polymer layers 71 and 72 into contact with the various contours of mold 60, the area between polymer layers 71 and 72 and proximal tensile member 50 may be pressurized. During a preparatory stage of this method, an injection needle may be located between polymer layers 71 and 72, and the injection needle may be located such that ridges 63 and 64 envelop the injection needle when mold 60 closes. A gas may then be ejected from the injection needle such that polymer layers 71 and 72 engage ridges 63 and 64, thereby forming an inflation conduit 73 (see FIG. 17) between polymer layers 71 and 72. The gas may then pass through inflation conduit 73, thereby entering and pressurizing the area proximal to tensile member 50. In combination with the vacuum, the internal pressure ensures that polymer layers 71 and 72 contact the various surfaces of mold 60.

Figure 16C:
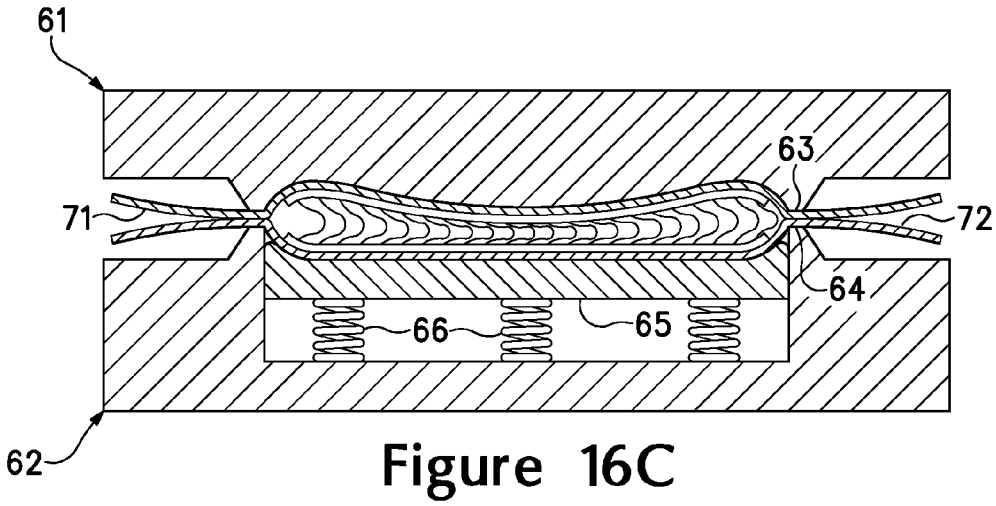

As mold 60 closes further, ridges 63 and 64 bond upper polymer layer 71 to lower polymer layer 72, as depicted in FIG. 16C, thereby forming peripheral bond 44. In addition, a movable insert 65 that is supported by various springs 66 may depress to place a specific degree of pressure upon the components, thereby bonding polymer layers 71 and 72 to tensile member 50. As discussed above, a supplemental layer or thermoplastic threads may be incorporated into tensile member 50 in order to facilitate bonding between tensile member 50 and barrier 40. The pressure exerted upon the components by insert 65 ensures that the supplemental layer or thermoplastic threads form a bond with polymer layers 71 and 72. Furthermore, portions of ridges 63 and 64 that extend away from tensile member 50 form a bond between other areas of polymer layers 71 and 72 to form inflation conduit 73.

Figure 17:
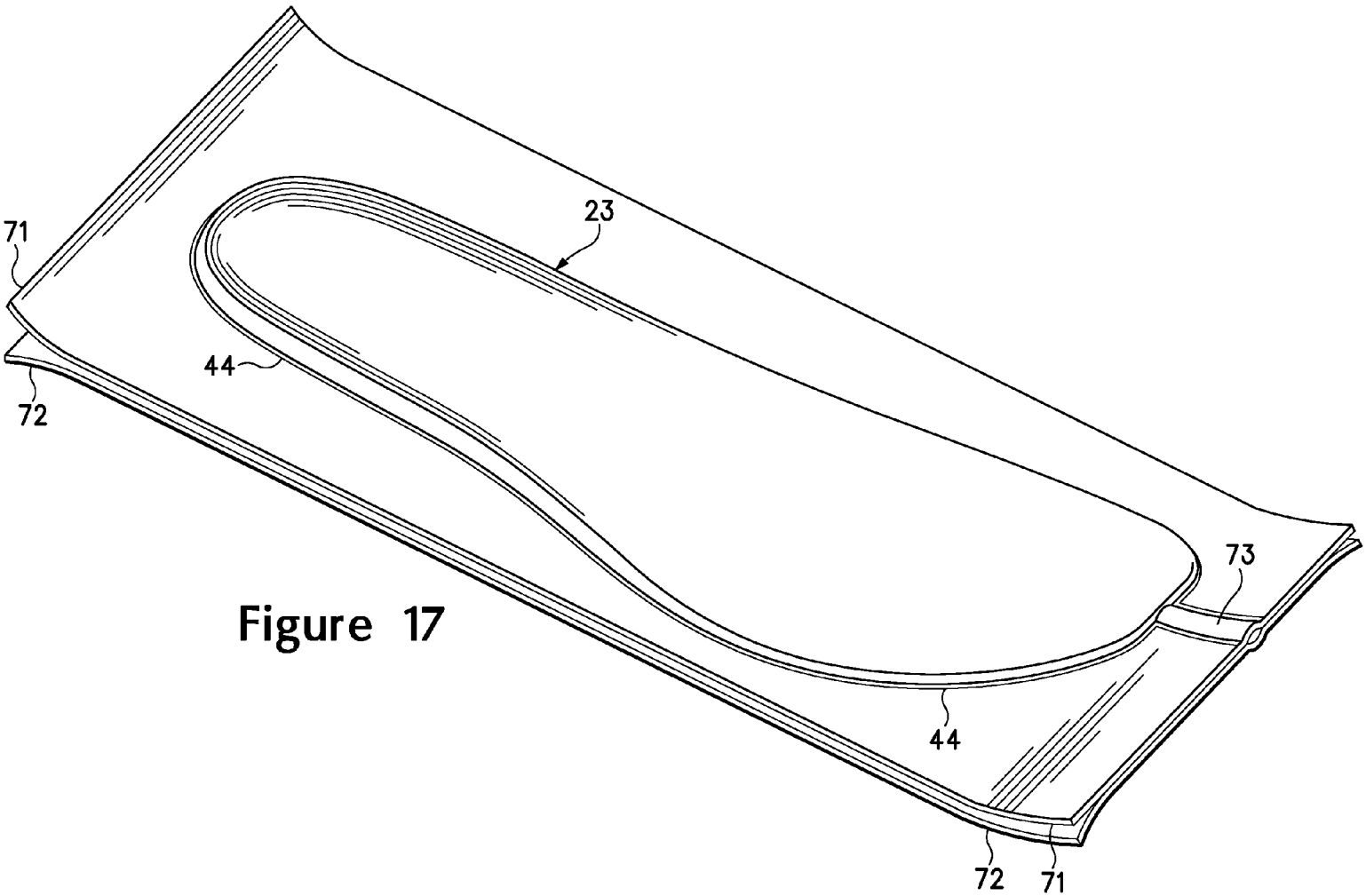
FIG. 17 is a perspective view of the chamber and residual portions of polymer sheets forming the chamber following the manufacturing process.

When bonding is complete, mold 60 is opened and chamber 33 and excess portions of polymer layers 71 and 72 are removed and permitted to cool, as depicted in FIG. 17. A fluid may be injected into chamber 33 through the inflation needle and inflation conduit 73. In addition, a sealing process is utilized to seal inflation conduit 73 adjacent to chamber 33 after pressurization. The excess portions of polymer layers 71 and 72 are then removed, thereby completing the manufacture of chamber 33. As an alternative, the order of inflation and removal of excess material may be reversed. As a final step in the process, chamber 33 may be tested and then incorporated into midsole 31 of footwear 10.

Based upon the above discussion, mold 60 is utilized to (a) impart shape to upper polymer layer 71 in order to form upper barrier portion 41 and an upper area of sidewall portion 43 (b) impart shape to lower polymer layer 72 in order to form lower barrier portion 42 and a lower area of sidewall barrier portion 43, and (c) forms peripheral bond 44 between polymer layers 71 and 72. Mold 60 also (a) bonds upper tensile layer 51 to the portion of upper polymer layer 71 that forms upper barrier portion 41 and (b) bonds lower tensile layer 52 to the portion of lower polymer layer 72 that forms lower barrier portion 42.

The surfaces of mold 60 that shape barrier portions 41 and 42 are depicted as being substantially parallel and planar. Chamber 33, however, exhibits a tapered configuration between heel region 13 and forefoot region 11, and upper barrier portion 41 forms a depression in heel region 13. When chamber 33 is pressurized, these contours may arise due to the configuration of tensile member 50. In further manufacturing processes, however, mold 60 may incorporate features (e.g., contours, protrusions, shaping) that correspond with the tapering and depression to facilitate the formation of the tapering and the depression. In addition to the configuration of tensile member 50, the configuration of mold 60 may also be utilized to impart a specific shape to chamber 33.

Further Configurations

Figure 18A:
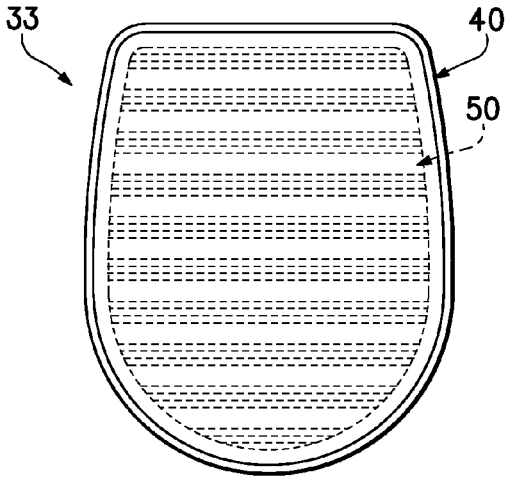
FIGS. 18A-18C are top plan views of additional configurations of the chamber.
Figure 18C:
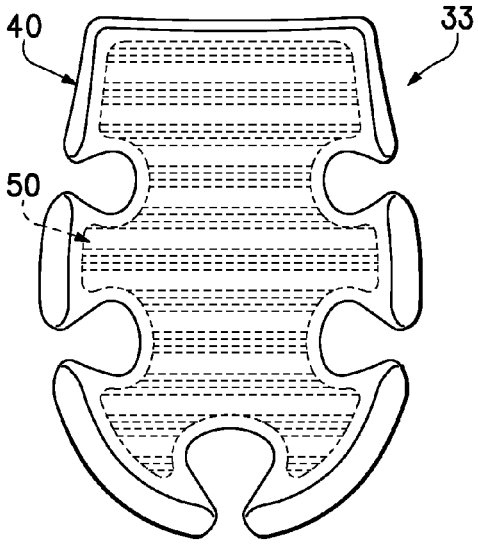
Figure 18B:
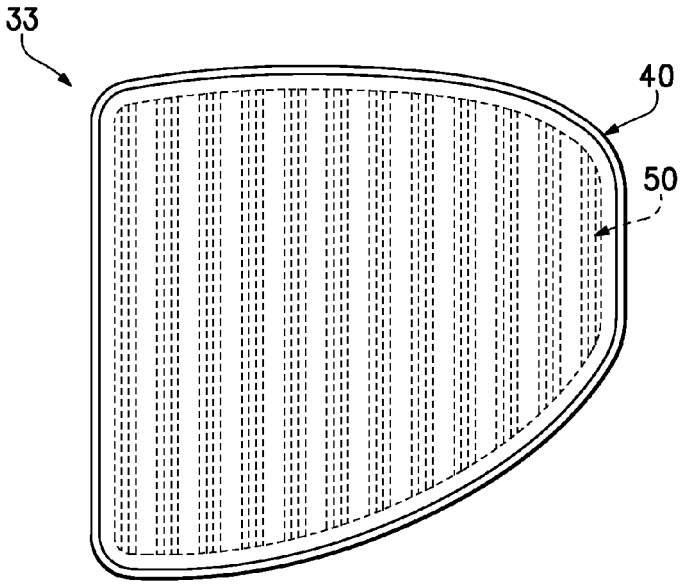

A suitable configuration for a fluid-filled chamber 33 that may be utilized with footwear 10 is depicted in FIGS. 3-9. A variety of other configurations may also be utilized. Referring to FIG. 18A, chamber 33 is depicted as having a configuration that may be utilized in heel region 13. Whereas FIGS. 3-9 depict a configuration that extends from heel region 13 to forefoot region 11, some configurations of chamber 33 may be limited to heel region 13. Similarly, FIG. 18B depicts a configuration of chamber 33 that may be limited to forefoot region 11. In other configurations, chamber 33 may exhibit a lobed structure, as depicted in FIG. 18C.

Figure 19A:
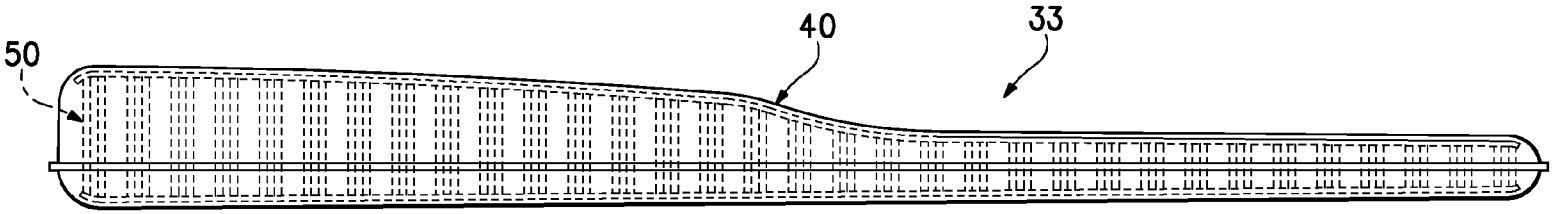
FIGS. 19A-19C are lateral side elevational views corresponding with FIG. 8 and depicting additional configurations of the chamber.
Figure 19B:
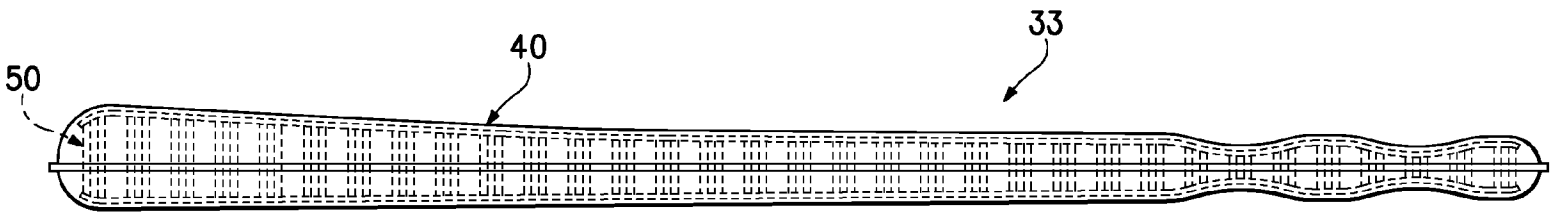
Figure 19C:
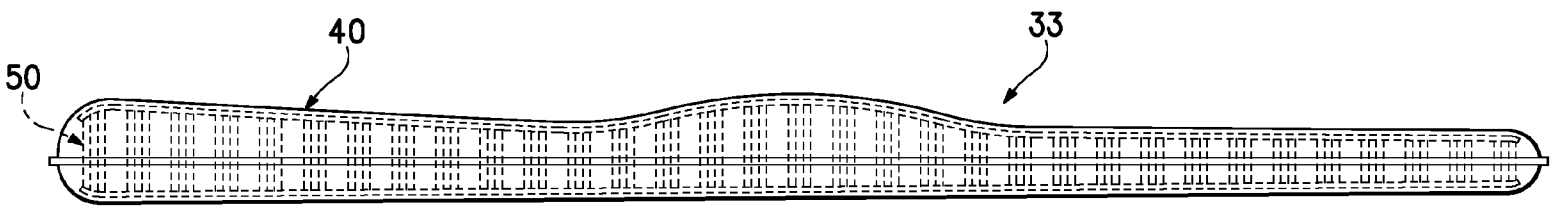

Chamber 33 is discussed above as being tapered between heel region 13 and forefoot region 11. As depicted in FIGS. 7 and 8, for example, the taper is relatively smooth such that the thickness of chamber 33 continually decreases from heel region 13 to forefoot region 11. As an alternative, chamber 33 may be formed to have planar areas in heel region 13 and forefoot region 11, with a transition in midfoot region 12, as depicted in FIG. 19A. In order to enhance the flexibility of chamber 33, tensile member 50 may be formed to have relatively thin areas that form depressions in one or both of barrier portions 41 and 42. For example, chamber 33 is depicted in FIG. 19B as having a pair of depressions in forefoot region 11 that enhance the flexibility of chamber 33 at a location corresponding with toes of the foot. In some further configurations, tensile member 50 may be formed to provide a protrusion in midfoot region 12 for supporting an arch of the foot, as depicted in FIG. 19C.

Figure 20A:
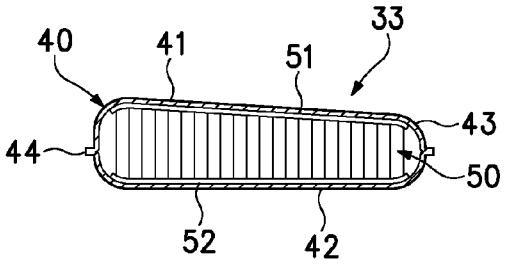
FIGS. 20A-20D are cross-sectional views corresponding with FIG. 6A and depicting additional configurations of the chamber.
Figure 20B:
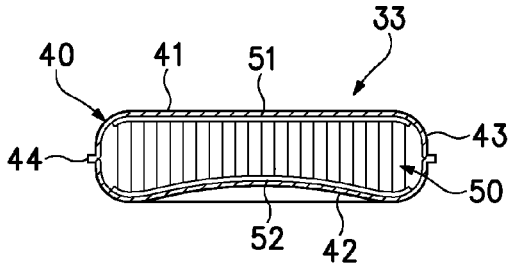
Figure 20C:
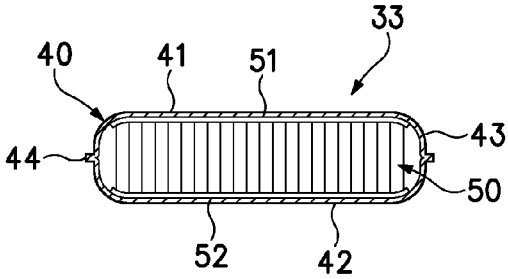

Although chamber 33 forms a depression in heel region 13, sides 14 and 15 have substantially identical thicknesses. In some configurations, chamber 33 may taper between medial side 15 and lateral side 14, as depicted in FIG. 20A. This taper may, for example, reduce the rate at which the foot pronates during running. Although the depression in heel region 13 is discussed above as being in upper barrier portion 41, the depression may also be in lower barrier portion 42, as depicted in FIG. 20B. In further configurations, the depression may be absent from chamber 33, as depicted in FIG. 20C.

Figure 20D:
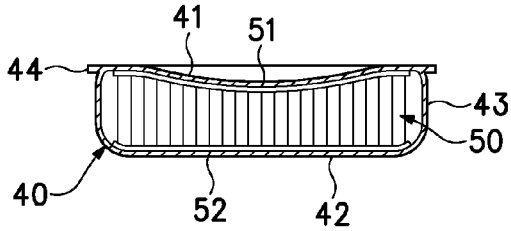

Peripheral bond 44 is depicted as being located between upper barrier portion 41 and lower barrier portion 42. That is, peripheral bond 44 is centered between barrier portions 41 and 42. In other configurations, however, peripheral bond 44 may be located on the same plane as either of barrier portions 41 and 42. As an example, peripheral bond 44 is depicted as being level with upper barrier portion 41 in FIG. 20D. In this configuration, therefore, upper polymer layer 71 is generally limited to forming upper barrier portion 41, whereas lower polymer layer 72 forms both of lower barrier portion 42 and sidewall barrier portion 43. An advantage of this configuration is that visibility through sidewall barrier portion 43 is enhanced when sidewall barrier portion 43 is visible on either of sides 14 and 15 of footwear 10.

Figure 21:
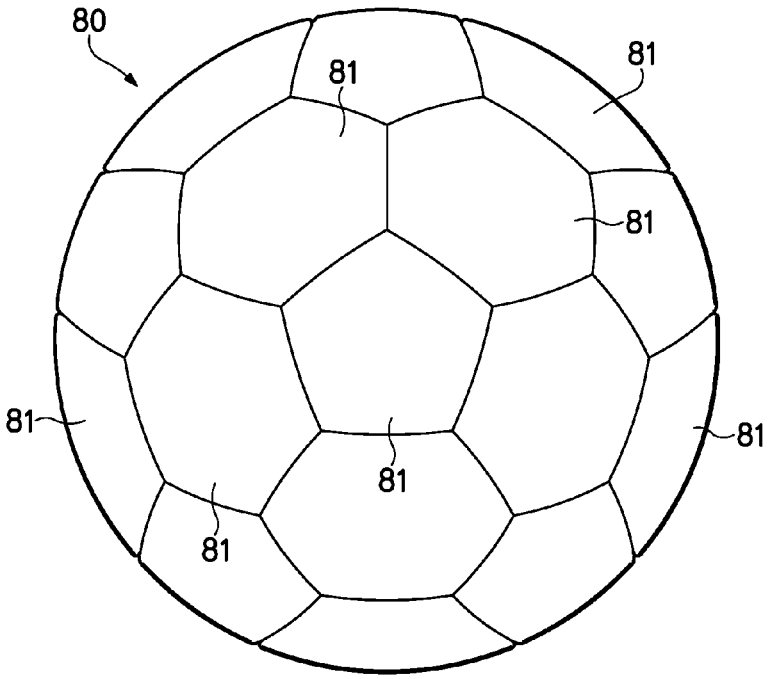
FIG. 21 is an elevational view of a ball incorporating a plurality panels with the configurations of fluid-filled chambers.
Figure 22:
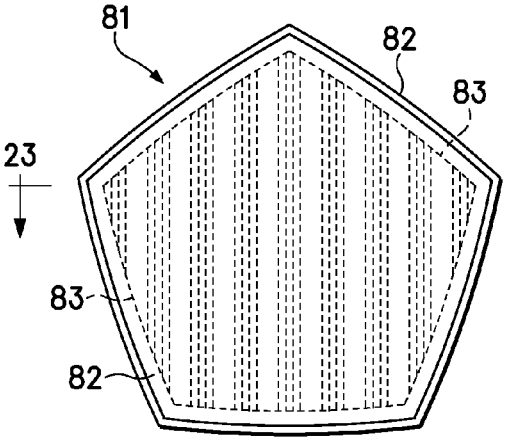
FIG. 22 is a top plan view of one of the panels.
Figure 23:
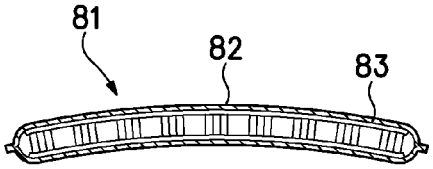
FIG. 23 is a cross-sectional view of the panel, as defined by section line 23-23 in FIG. 22.

Chamber 33 is discussed above as having a configuration that is suitable for footwear. In addition to footwear, chambers having similar configurations may be incorporated into other types of apparel and athletic equipment, including helmets, gloves, and protective padding for sports such as football and hockey. Similar chambers may also be incorporated into cushions and other compressible structures utilized in household goods and industrial products. Referring to FIG. 21, a ball 80 having the configuration of a soccer ball is depicted as including a plurality of pentagonal and hexagonal panels 81. Each of panels 81 have the configuration of a fluid-filled chamber that is similar to chamber 33. More particularly, and with reference to FIGS. 22 and 23, one of panels 81 is depicted as having a barrier 82 and a tensile member 83 located within barrier 82. Each of panels 81 have curved surfaces that combine to form a generally spherical shape for ball 80. In forming each of panels 81 and imparting curved contouring to panels 81, tensile member 83 may be knitted or otherwise formed to have a curved configuration, which may have a finished configuration.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A fluid-filled chamber comprising:

an outer barrier formed of a polymer material that defines an interior void;

a tensile member located within the interior void and bonded to opposite sides of the barrier, the tensile member being formed from a textile element that includes a pair of spaced layers joined by a plurality of connecting members, each of the layers having an edge, at least a portion of one of the edges having a finished configuration, wherein ends of yarn forming the layers are substantially absent from the edges; and a fluid located within the interior void, the fluid being pressurized to place an outward force upon the barrier and induce tension in at least a portion of the connecting members.

2. The chamber recited in claim 1, wherein at least a portion of the layers are non-parallel.

3. The chamber recited in claim 1, wherein at least one of the layers is contoured.

4. The chamber recited in claim 1, wherein the edges of both of the layers have the finished configuration.

5. The chamber recited in claim 1, wherein the chamber is incorporated into an article of footwear.

6. An article of footwear having an upper and a sole structure secured to the upper, at least one of the upper and the sole structure incorporating a fluid-filled chamber comprising:

an outer barrier formed of a polymer material that defines an interior void, the barrier having:

a first portion that forms a first surface of the chamber, a second portion that forms an opposite second surface of the chamber, and a sidewall portion that that extends between the first portion and the second portion to form a sidewall of the chamber;

a tensile member located within the interior void and formed from a plurality of yarns, the tensile member including:

a first layer joined to the first portion of the barrier, ends of the yarns being substantially absent from an edge of the first layer, a second layer spaced from the first layer and joined to the second portion of the barrier, ends of the yarns being substantially absent from an edge of the second layer, and at least a portion of the second layer being non-parallel to the first layer, and a plurality of connecting members extending between the first layer and the second layer; and a fluid located within the void, the fluid being pressurized to place an outward force upon the barrier and induce tension in at least a portion of the connecting members.

7. The article of footwear recited in claim 6, wherein at least one of the first layer and the second layer is contoured.

8. The article of footwear recited in claim 6, wherein the chamber is located within the sole structure.

9. The article of footwear recited in claim 8, wherein a heel portion of the chamber has a greater thickness than a forefoot portion of the chamber.

10. The article of footwear recited in claim 8, wherein a peripheral portion of the chamber has a greater thickness than a central portion of the chamber.

11. A method of manufacturing a fluid-filled chamber, the method comprising:

knitting a tensile member to have a shape of the chamber; and locating the tensile member within a polymer barrier and bonding the tensile member to opposite sides of the barrier;

wherein the step of knitting includes utilizing yarn, and the step of knitting further includes finishing at least one edge of the tensile member such that ends of the yarn are substantially absent from the edge.

12. The method recited in claim 11, wherein the step of knitting includes dimensioning the tensile member to have a lesser width and a lesser length than the chamber.

13. The method recited in claim 11, wherein the step of knitting includes utilizing a flat-knitting machine.

14. The method recited in claim 11, wherein the step of knitting includes forming a first area and a second area of the tensile member to have different thicknesses.

15. The method recited in claim 11, wherein the step of knitting includes forming a surface of the tensile member to have a contoured configuration.

16. The method recited in claim 11, further including a step of incorporating the chamber into an article of footwear.

17. A method of manufacturing a fluid-filled chamber, the method comprising:

utilizing a flat-knitting apparatus to form a textile tensile member with at least one contoured surface;

finishing at least one edge of the tensile member such that ends of yarn within the tensile member are substantially absent from the edge; and locating the tensile member within a polymer barrier and bonding the tensile member to opposite sides of the barrier.

18. The method recited in claim 17, wherein the step of utilizing the flat-knitting apparatus includes forming the tensile member to have a shape of the chamber and dimensioning the tensile member to have a lesser width and a lesser length than the chamber.

19. The method recited in claim 17, further including a step of incorporating the chamber into an article of footwear.

20. A method of manufacturing a fluid-filled chamber, the method comprising:

knitting a tensile member with a first layer, a second layer spaced from the first layer, and a plurality of connecting members with varying lengths extending between the first layer and the second layer;

finishing edges of the first layer and the second layer such that ends of yarn within the tensile member are substantially absent from the edges;

locating the tensile member within a polymer barrier and bonding the first layer and the second layer to opposite sides of the barrier; and pressurizing the barrier to place the connecting members in tension.

21. The method recited in claim 20, wherein the step of knitting includes forming the tensile member to have a shape of the chamber and dimensioning the tensile member to have a lesser width and a lesser length than the chamber.

22. The method recited in claim 20, wherein the step of knitting includes forming a first area and a second area of the tensile member to have different thicknesses.

23. The method recited in claim 20, further including a step of incorporating the chamber into an article of footwear.

* * * * *